US005351666A

United States Patent [19]

Bronkal et al.

[11] Patent Number: 5,351,666

[45] Date of Patent: Oct. 4, 1994

[54] METHOD AND DEVICE FOR CONTROLLING AN INTERNAL COMBUSTION ENGINE

[75] Inventors: Bernhard Bronkal, Koengen; Martin Grosser, Korntal, both of Fed. Rep. of Germany

[73] Assignee: Robert Bosch GmbH, Stuttgart, Fed. Rep. of Germany

[21] Appl. No.: 80,792

[22] Filed: Jun. 22, 1993

[30] Foreign Application Priority Data

Sep. 4, 1992 [DE] Fed. Rep. of Germany ..... 4229540

[51] Int. Cl.[5] ..... F02D 41/06

[52] U.S. Cl. ..... 123/359; 123/179.17

[58] Field of Search ..... 123/359, 179.16, 179.17, 123/198 DB, 366

[56] References Cited

U.S. PATENT DOCUMENTS

| | | | |
|---|---|---|---|
| 4,402,290 | 9/1983 | Höfer | 123/359 |
| 4,516,550 | 5/1985 | Buck et al. | 123/357 |
| 4,602,600 | 7/1986 | Akatsuka et al. | 123/179.17 |
| 4,785,771 | 11/1988 | Ibuki et al. | 123/179.17 |
| 4,787,352 | 11/1988 | Anderson | 123/359 |
| 4,850,320 | 7/1989 | Wokan et al. | 123/359 |
| 4,867,115 | 9/1989 | Henein | 123/179.17 |
| 4,903,670 | 2/1990 | Bauder | 123/359 |
| 5,179,920 | 1/1993 | Bender | 123/198 DB |
| 5,188,077 | 2/1993 | Bauder | 123/359 |

FOREIGN PATENT DOCUMENTS

| | | | |
|---|---|---|---|
| 0266304 | 5/1988 | European Pat. Off. . | |
| 2945484.0 | 5/1981 | Fed. Rep. of Germany . | |
| 3209433.7 | 9/1983 | Fed. Rep. of Germany . | |
| 59-090761 | 5/1984 | Japan . | |
| 213935 | 12/1984 | Japan | 123/359 |
| 59-221438 | 12/1984 | Japan . | |
| 2047351 | 11/1980 | United Kingdom . | |

*Primary Examiner*—E. Rollins Cross
*Assistant Examiner*—Thomas N. Moulis
*Attorney, Agent, or Firm*—Kenyon & Kenyon

[57] ABSTRACT

In a method and device for controlling an internal combustion engine, particularly a diesel engine, when the internal combustion engine is started up, a power-regulating, controlling mechanism is triggered in a first step so as to allow it to assume a starting position. A starter is triggered in a subsequent step. An interrupting device, which is operatively connected to the power-regulating, controlling mechanism, is released only after a safety condition is fulfilled.

12 Claims, 2 Drawing Sheets

METHOD AND DEVICE FOR CONTROLLING AN INTERNAL COMBUSTION ENGINE

FIELD OF THE INVENTION

The present invention relates to a method and device for controlling an internal combustion engine.

BACKGROUND INFORMATION

A method and a device for controlling an internal combustion engine, and in particular a diesel engine during the start-up operation, are described in U.S. Pat. No. 4,516,550, which corresponds to German Unexamined Patent Application No. 32 09 433. In the method described therein, the fuel quantity is specified dependent upon an r.p.m. value and upon a time condition.

Associated with this method and this device is the disadvantage that a defect in the speed sensor leads to unacceptable operating conditions. If the speed sensor fails, the speed signal does not attain the designated limiting value. The result is a continuous increase in the fuel quantity to be injected. This leads to unacceptable operating conditions for the internal combustion engine.

U.S. Pat. No. 4,402,290, which corresponds to German Unexamined Patent Application No. 29 45 484, describes an interrupting device, which usually enables the internal combustion engine to be turned off when unacceptable operating conditions occur. In one specific embodiment, the starting quantity is released only when the r.p.m. value has exceeded a specified value. The disadvantage of this procedure is that the starter is first actuated and then the starting quantity is released. This can result in the controlling (positioning) mechanism not reaching the position required for the starting quantity, particularly when there is a drop in the supply voltage. It is thus feasible that no start-up operation is possible when a battery is not completely intact, particularly at low temperatures.

SUMMARY OF THE INVENTION

In a method and device for controlling an internal combustion engine according to the present invention, a power-regulating, controlling mechanism is triggered so as to allow it to assume a starting position, when the engine is started. A starter for the engine is subsequently actuated. It is then determined whether a safety condition is fulfilled. A flow of fuel to the engine is released by an interrupting device, which is operatively coupled to the power-regulating, controlling mechanism, only after the safety condition is fulfilled.

One advantage of the method and device according to the present invention is that the internal combustion engine is able to be reliably started even when there is a drop in the supply voltage.

DETAILED DESCRIPTION

The method according to the present invention will be described using the example of a gasoline engine. It can also be applied, however, to other internal combustion engines. In this case, appropriate elements are triggered. Thus, in the case of a diesel engine, a control rod or an adjusting lever serves as a power-regulating controlling mechanism. In an internal combustion engine having applied spark ignition, the throttle valve can be designated as the power-regulating controlling mechanism.

Figure 1:
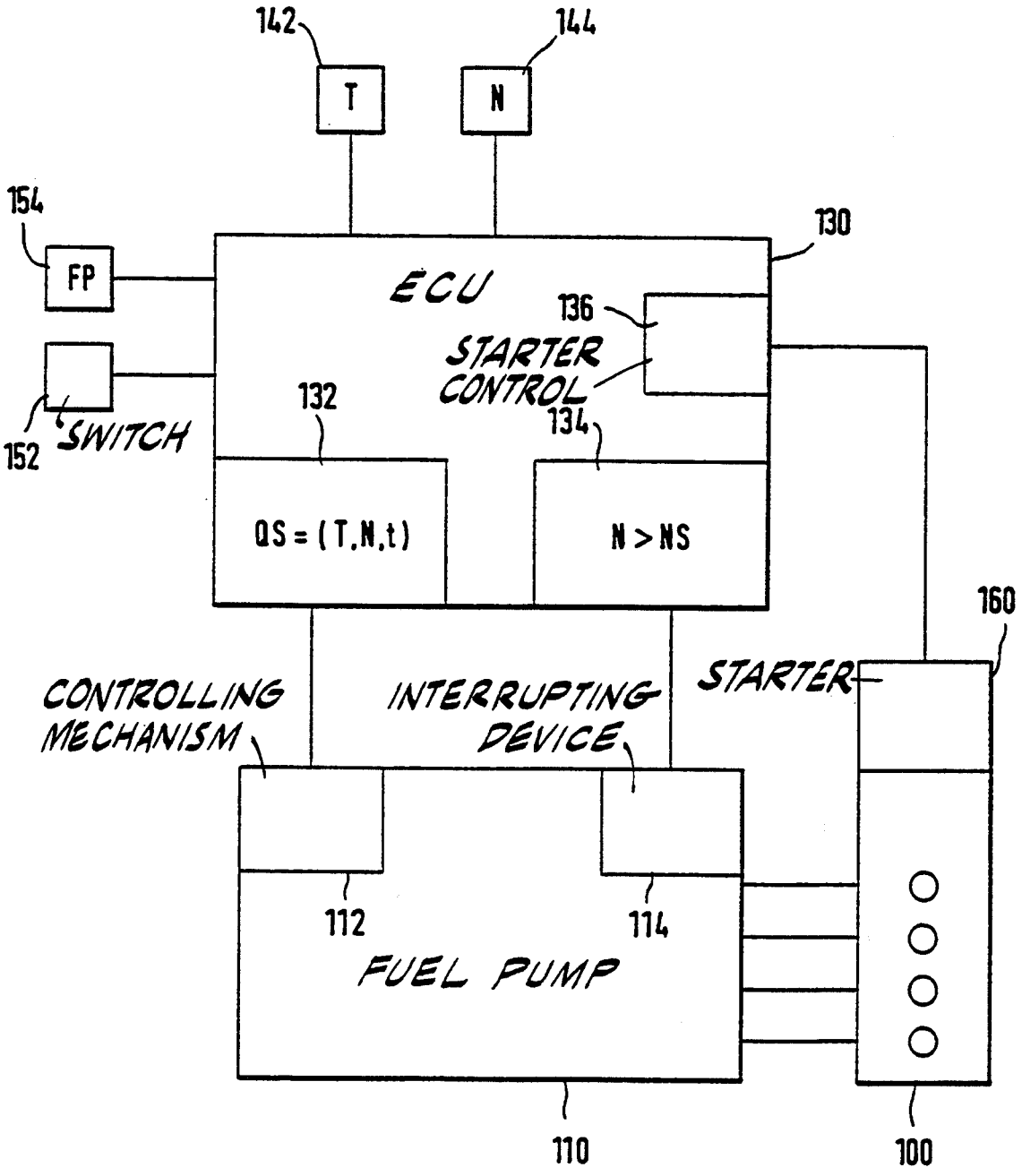
FIG. 1 shows a block diagram of the device according to the present invention.

In FIG. 1, the device according to the present invention is illustrated by a block diagram. A fuel pump 110 meters fuel into an internal combustion engine 100 via one or more fuel lines. The fuel pump 110 comprises, inter alia, a controlling mechanism 112 and an interrupting device 114. The controlling mechanism 112 and, in particular, the interrupting device 114 can instead be arranged on or separately from the fuel pump.

The controlling mechanism 112 and the interrupting device 114 receive signals from an electronic control unit 130. The controlling mechanism 112 receives signals from a unit for controlling injected fuel quantity 132. The interrupting device 114 receives signals from a safety device 134.

The electronic control unit 130 also comprises a starter control 136, which sends signals to a starter 160. Furthermore, the electronic control unit 130 communicates with sensors 142 for temperature values and with a sensor 144 for the r.p.m. of the internal combustion engine.

Furthermore, signals from operating (control) elements 152 and 154 are supplied to the control unit 130. These operating elements generate a signal pertaining to the position of the gas pedal 154, as well as a signal indicating the position of a switch 152.

The device shown in FIG. 1 functions as follows. The fuel pump 110 compresses the fuel to the necessary injection pressure. The fuel quantity supplied to the internal combustion engine is established by the controlling mechanism 112. To this end, the unit for controlling injected fuel quantity 132 calculates a corresponding quantity signal dependent upon the sensor signals and the position of the operating element 154. As a rule, the position of the operating element 154 is not considered at start-up.

In the case of the fuel pump 110, one should differentiate between a suction chamber and an element chamber. The suction chamber is charged with fuel under a relatively low pressure. The fuel is compressed in the element chamber to a relatively high pressure, which is required for the dosing operation. The fuel supply can be interrupted or released by means of the interrupting device 114. Thus, for example, the interrupting device breaks off the connection between the suction chamber and the element chamber. Such an interruption takes place when the internal combustion engine is turned off, or when certain safety conditions are exceeded. Turning the internal combustion engine on or off is signalled by the driver through the actuation of the corresponding operating element 152.

When an actuation of the operating element 152 indicates that the driver would like to start up the internal combustion engine, the starter control 136 sends a signal to the starter 160. As a result, the starter drives the internal combustion engine. Before the starting operation, the quantity control 132 outputs a starting quantity QS dependent upon one or more temperature values, the r.p.m. value and, in some instances, a time condition. The controlling mechanism 112 receives this signal. Usually, this starting quantity QS is greater than the quantity signals which occur in normal operation.

In the case of conventional methods for controlling fuel metering, an appropriate starting quantity is usually output first by triggering the controlling mechanism. The starter 160 is subsequently actuated. Associated with this procedure is, inter alia, the disadvantage that should the speed sensor fail, the starting quantity is metered in and, in some instances, continuously increased, because the starting operation is interrupted and the starting quantity is reduced only when a specific r.p.m. value exists. For as long as the internal combustion engine has not reached a so-called start-release speed, the starting quantity is retained or even increased. This continuous increase in the starting quantity QS can lead to unacceptable operating conditions for the internal combustion engine.

Therefore, in the case of one known method, at least two speed sensors are provided, so that should one speed sensor fail, a reliable speed acquisition is guaranteed by means of the second speed sensor. An unacceptable operating state, which exists after the starter is actuated, can be prevented to the greatest possible extent by the speed redundancy. However, solving the problem in this manner is very costly, since two speed sensors are needed.

In another known method, the second speed sensor is not needed. In this method, the starting quantity is released only after a speed threshold is exceeded after the starter is actuated. In this case, the disadvantage results that the starter actuation demands considerable power. This, in turn, leads to a drop in the battery voltage. In case of a sharp drop in the battery voltage, the case can occur, inter alia, that the energy that is still available no longer suffices to bring the controlling mechanism 112 to the designated position.

In the case of a correspondingly low power supply voltage, it can happen that the controlling mechanism does not assume the appropriate position for the starting quantity and, consequently, the fuel pump 110 cannot inject the intended starting quantity QS. In this case, it is not possible to start up the internal combustion engine.

The internal combustion engine is usually turned oil by the interrupting device 114. In the case of a repeated actuation of the operating element 152 to start the internal combustion engine, the interrupting device 114 is in its closed state. Therefore, the interrupting device 114 is usually opened first in the case of conventional devices.

Figure 2:
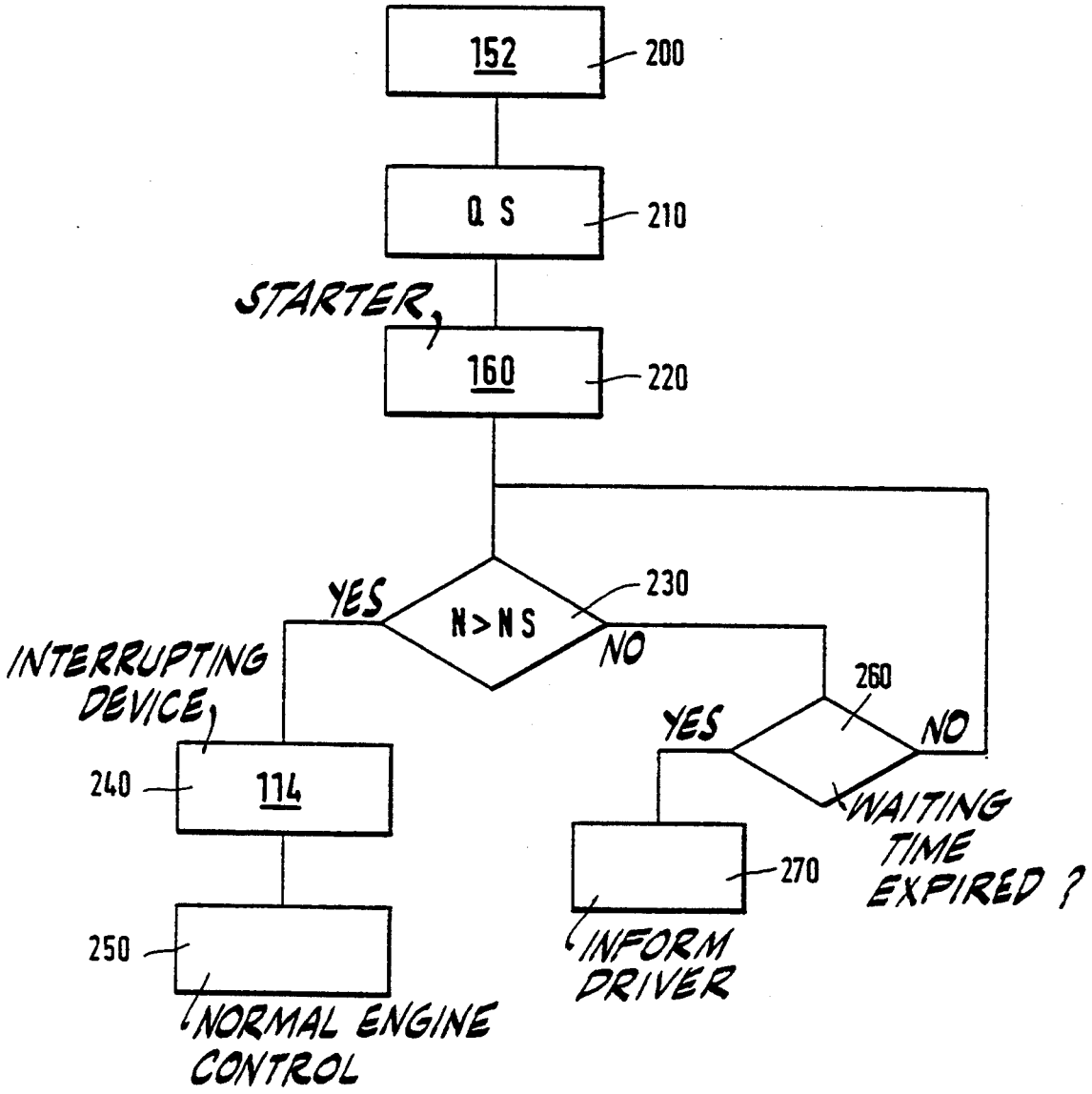
FIG. 2 shows a flow chart for illustrating the method according to the present invention.

As depicted in the flow chart of FIG. 2, the procedure according to the present invention at the time of start-up is as follows. After it is recognized in a first step 200, on the basis of the position of the operating element 152, that the driver of the vehicle wants to start the internal combustion engine, a starting quantity QS, which is at least dependent upon the temperature, is specified in a second step 210 by the unit for controlling injected fuel quantity 132. The controlling mechanism 112 receives this quantity signal, and then assumes the appropriate position. However, fuel is not metered in, because the interrupting device has not yet released the fuel to be supplied.

The starter 160 is subsequently actuated in a further step 220. If the safety device 134 recognizes in step 230 that a safety condition is fulfilled, it transmits a signal to the interrupting device 114, which causes the interrupting device to open. As a safety condition, it can be provided, inter alia, that a query is made whether the r.p.m. value N is rising above a specified threshold NS. This speed threshold NS is selected to correspond roughly to the starting speed, and should amount more or less to 90% of the starting speed. This is the speed detected by the speed sensor when the starter 160 drives the internal combustion engine.

When the starting speed is reached, this is interpreted to mean that the speed sensor is functioning properly. If the starting speed is not reached, the speed sensor or the starter is defective. The first case represents an emergency which is critical to safety, and the fuel supply must not be released. If the starter is defective, it is not necessary for the fuel supply to be released, since no start-up is possible when a starter is defective.

Subsequent to step 240, the usual control continues in step 250. If the r.p.m. value is less than the speed threshold NS, a time query 260 follows. If this time query reveals that a waiting time has not yet expired, it is then tested again in step 230 whether the r.p.m. value N is greater than the speed threshold. If the time query 260 recognizes that the waiting time has expired, the driver is informed in step 270, by means of suitable display devices, that it is not possible to start-up the internal combustion engine. A control lamp can be used, for example, as a display device.

Since the sequence in which the individual elements are actuated can be specially selected in this manner, it can be guaranteed that the fuel supply is released only when the speed sensor is functioning properly. Furthermore, in case of a low supply voltage, it can also be guaranteed that the controlling mechanism 112 can reach the appropriate position.

What is claimed is:

1. A method of controlling an internal combustion engine, comprising the steps of:

triggering a power-regulating, controlling mechanism into a starting position when an engine starting procedure is initiated;

subsequently actuating a starter for the engine;

determining whether a safety condition is fulfilled; and releasing a flow of fuel to the engine by an interrupting device operatively coupled to the power-regulating, controlling mechanism only after the safety condition is fulfilled.

2. The method according to claim 1, wherein the engine is a diesel engine.

3. The method according to claim 1, wherein the determining step includes the step of determining whether an engine r.p.m. value is greater than a preselected threshold value.

4. The method according to claim 3, wherein the flow of fuel is released only when the engine r.p.m. value is greater than the threshold value.

5. The method according to claim 3, wherein the threshold value is at least as low as an engine starting speed.

6. The method according to claim 1, further comprising the steps of:

determining whether a time condition is fulfilled; and determining whether a speed condition is fulfilled after the time condition is fulfilled.

7. The method according to claim 1, further comprising the step of informing a driver through a display device if it is not possible to start the engine.

8. A device for controlling an internal combustion engine, comprising:

means for triggering a power-regulating, controlling mechanism into a starting position when an engine starting procedure is initiated;

means for subsequently actuating a starter for the engine; and means for determining whether a safety condition is fulfilled and for controlling an interrupting device operatively coupled to the power-regulating, controlling mechanism to release a flow of fuel to the engine only after the safety condition is fulfilled.

9. The device according to claim 8, wherein the engine is a diesel engine.

10. The device according to claim 8, wherein the power-regulating, controlling mechanism determines a fuel quantity supplied to the engine.

11. The device according to claim 8, wherein the means for determining further determines whether an engine r.p.m. value is greater than a preselected threshold value.

12. The device according to claim 11, wherein the flow of fuel is released only when the engine r.p.m. value is greater than the threshold value.

* * * * *

UNITED STATES PATENT AND TRADEMARK OFFICE

CERTIFICATE OF CORRECTION

PATENT NO. : 5,351,666
DATED : Oct. 4, 1994
INVENTOR(S) : BRONKAL et al.

It is certified that error appears in the above-indentified patent and that said Letters Patent is hereby corrected as shown below:

Column 1, line 64, "gasoline" should be --diesel--; and
Column 3, line 40, "oil" should be --off--.

Signed and Sealed this
Twenty-fifth Day of April, 1995

*Attest:*

Bruce Lehman

BRUCE LEHMAN

*Attesting Officer*

*Commissioner of Patents and Trademarks*